US009889456B2

(12) United States Patent
Vanvalkenburgh

(10) Patent No.: US 9,889,456 B2
(45) Date of Patent: Feb. 13, 2018

(54) DRYWALL TEXTURE APPLICATION DEVICE

(71) Applicant: David Vanvalkenburgh, Tampa, FL (US)

(72) Inventor: David Vanvalkenburgh, Tampa, FL (US)

(73) Assignee: SprayNoz LLC, Lutz, FL (US)

( * ) Notice: Subject to any disclaimer, the term of this patent is extended or adjusted under 35 U.S.C. 154(b) by 0 days.

(21) Appl. No.: 14/642,184

(22) Filed: Mar. 9, 2015

(65) Prior Publication Data

US 2015/0306612 A1 Oct. 29, 2015

Related U.S. Application Data

(60) Provisional application No. 61/983,065, filed on Apr. 23, 2014.

(51) Int. Cl.

| | |
|---|---|
| ***A62C 5/02*** | (2006.01) |
| ***B05B 7/24*** | (2006.01) |
| ***G10K 11/178*** | (2006.01) |
| ***H04R 1/22*** | (2006.01) |
| ***H04R 3/04*** | (2006.01) |
| ***B05B 7/08*** | (2006.01) |

(52) U.S. Cl.

CPC ..... *B05B 7/2464* (2013.01); *B05B 7/0884* (2013.01); *B05B 7/2429* (2013.01); *B05B 7/2491* (2013.01); *G10K 11/178* (2013.01); *H04R 1/22* (2013.01); *H04R 3/04* (2013.01); *H04R 2410/03* (2013.01)

(58) Field of Classification Search

CPC ... B05B 7/2464; B05B 7/0884; B05B 7/2429; B05B 7/2491; G10K 11/178

USPC ..... 239/8, 306, 314, 418

See application file for complete search history.

(56) References Cited

U.S. PATENT DOCUMENTS

| | | | | |
|---|---|---|---|---|
| 817,819 | A * | 4/1906 | Walkup | B05B 7/2429 128/200.14 |
| 1,822,553 | A * | 9/1931 | Uphoff | B05B 7/2429 239/341 |
| 4,923,743 | A * | 5/1990 | Stewart, Jr. | B05B 7/066 118/315 |
| 5,685,934 | A * | 11/1997 | Ikeda | B05B 7/067 118/302 |
| 5,785,252 | A * | 7/1998 | Keim | B05B 7/0441 239/418 |
| 6,062,494 | A | 5/2000 | Mills | |
| 6,318,642 | B1 * | 11/2001 | Goenka | B05B 7/025 239/290 |
| 6,848,633 | B2 * | 2/2005 | Ryser | B01L 3/0268 239/340 |
| 6,997,405 | B2 * | 2/2006 | Haruch | B05B 7/0861 239/290 |
| 8,551,572 | B1 | 10/2013 | Tait et al. | |
| 2006/0038027 | A1 * | 2/2006 | O'Connor | B05B 7/066 239/8 |

(Continued)

*Primary Examiner* — Arthur O Hall
*Assistant Examiner* — Joel Zhou
(74) *Attorney, Agent, or Firm* — Sandra L. Layer

(57) ABSTRACT

A device for applying drywall texture material to a surface is provided. The device generally comprises a hollow tube for holding drywall joint compound, a spray nozzle with a removably attached air hose, a piston, and a ramrod. The device allows users to easily apply drywall joint compound to a surface to create various surface textures.

16 Claims, 5 Drawing Sheets

(56) References Cited

U.S. PATENT DOCUMENTS

| | | | |
|---|---|---|---|
| 2007/0158464 | A1 | 7/2007 | Olson et al. |
| 2007/0246570 | A1 | 10/2007 | Cataline |
| 2011/0297754 | A1 | 12/2011 | Valdez |

* cited by examiner

DRYWALL TEXTURE APPLICATION DEVICE

CROSS REFERENCE TO RELATED APPLICATION

This application claims the benefit of U.S. Provisional Application No. 61/983,065 filed on Apr. 23, 2014. The above identified patent application is herein incorporated by reference in its entirety to provide continuity of disclosure.

FIELD OF THE INVENTION

The present invention relates to a device for applying drywall joint compound to a surface in a textured manner.

BACKGROUND

Drywall joint compound has long been used in building construction to create various surface textures on ceilings and walls. Different drywall textures, such as orange peel, knockdown, or stucco, provide different aesthetic and acoustic effects. Devices and apparatuses for applying drywall joint compound, also known as "drywall mud," exist in the prior art. These devices typically mix drywall texture material and water to form drywall mud and then mix the mud with a stream of compressed air, which forces the mud out of a nozzle onto the surface to be coated. Other devices exist that utilize pre-mixed drywall mud.

Drywall texture application devices are commonly designed for commercial uses including, for example, applying texture to large surface areas such as building interior and exterior walls. These devices are typically mounted on a vehicle bed or towed as a trailer. Such devices tend to be costly and require extensive training in order to be used safely, making them impractical for personal use. Therefore, it is desirable to provide a device that allows an untrained individual to safely and easily apply drywall joint compound to a surface to create a desired drywall texture.

Portable drywall sprayers known as hoppers that feeds texture material to an attached spray gun. These devices typically rely on gravity to feed drywall mud vertically from the hopper to the spray nozzle. Consequently, this and similar devices are difficult to use for coating ceilings and other overhead surfaces because tilting the hopper horizontally interrupts the flow of texture material to the spray gun. It is therefore desired to provide a device that can be easily filled with drywall joint compound and can be used to apply texture to ceilings and other overhead surfaces.

Other types of drywall texture devices exist in the art, including shoulder-mounted texture sprayers. Such devices tend to be unwieldy and cause difficulty when applying texture to ceilings or other overhead surfaces. Another drawback of this and other similar devices is that they utilize an inflatable bag to move drywall mud to a spray gun, which is prone to rupture and may cause the device to fail. Therefore, it is desired to provide a handheld drywall texture application device with minimal mechanical elements that is designed such that it can be easily and comfortably used to apply texture to ceilings and other overhead surfaces.

There exists portable drywall application devices in the prior art that allow users to customize the texture pattern by changing the rate of the compressed air flow. However, there are many commonly used drywall texture patterns, such as knockdown, orange peel, and stucco. Whether freshly applying a particular texture or matching a texture for patch jobs, calibrating the device requires a trial and error process.

Therefore, a device that can accommodate a plurality of nozzle fittings, each of which provides a particular texture pattern, is desired.

In view of the above recognized problems, therefore, it is desired to provide a handheld drywall texture application device that is both safe and easy for personal use that can be used to apply drywall texture to any surface.

SUMMARY OF THE INVENTION

In view of the foregoing disadvantages inherent in the known types of drywall texture application devices now present in the prior art, the object of the present invention is to provide a drywall texture application device having a hollow tube having a first end and a second end, a piston slidably disposed within the hollow tube, a ramrod attached to the piston and extending toward the second end of the tube, and a spray nozzle connected to the first end of the hollow tube, the spray nozzle having an inner channel, a fluid nozzle, an air cap having an inner aperture interchangeably attached thereto, and a connector connectable to an external air source.

Another object of the present invention is to provide a handheld drywall texture application device that has an air cap having one or more outer apertures disposed around the inner aperture, the one or more outer apertures being in fluid communication with the external air supply via the connector.

A further object of the present invention is to provide a handheld drywall texture application device where the spray nozzle inner channel comprises a first chamber having an inlet in communication with the hollow tube and an outlet in communication with the fluid nozzle, and a second chamber having an inlet in communication with the connector and an outlet in communication with the air cap, wherein depressing the piston causes material within the tube to be forced into the first chamber and expelled therefrom through the fluid nozzle.

Still a further object of the present invention is to provide a handheld drywall texture application device having an air cap having an inner aperture removably attached to a spray nozzle around a fluid nozzle, and at least one outer aperture disposed around the inner aperture, wherein air from an external air source exits through the at least one outer aperture and disperses the material expelled from the fluid nozzle.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE DRAWINGS

Figure 1:
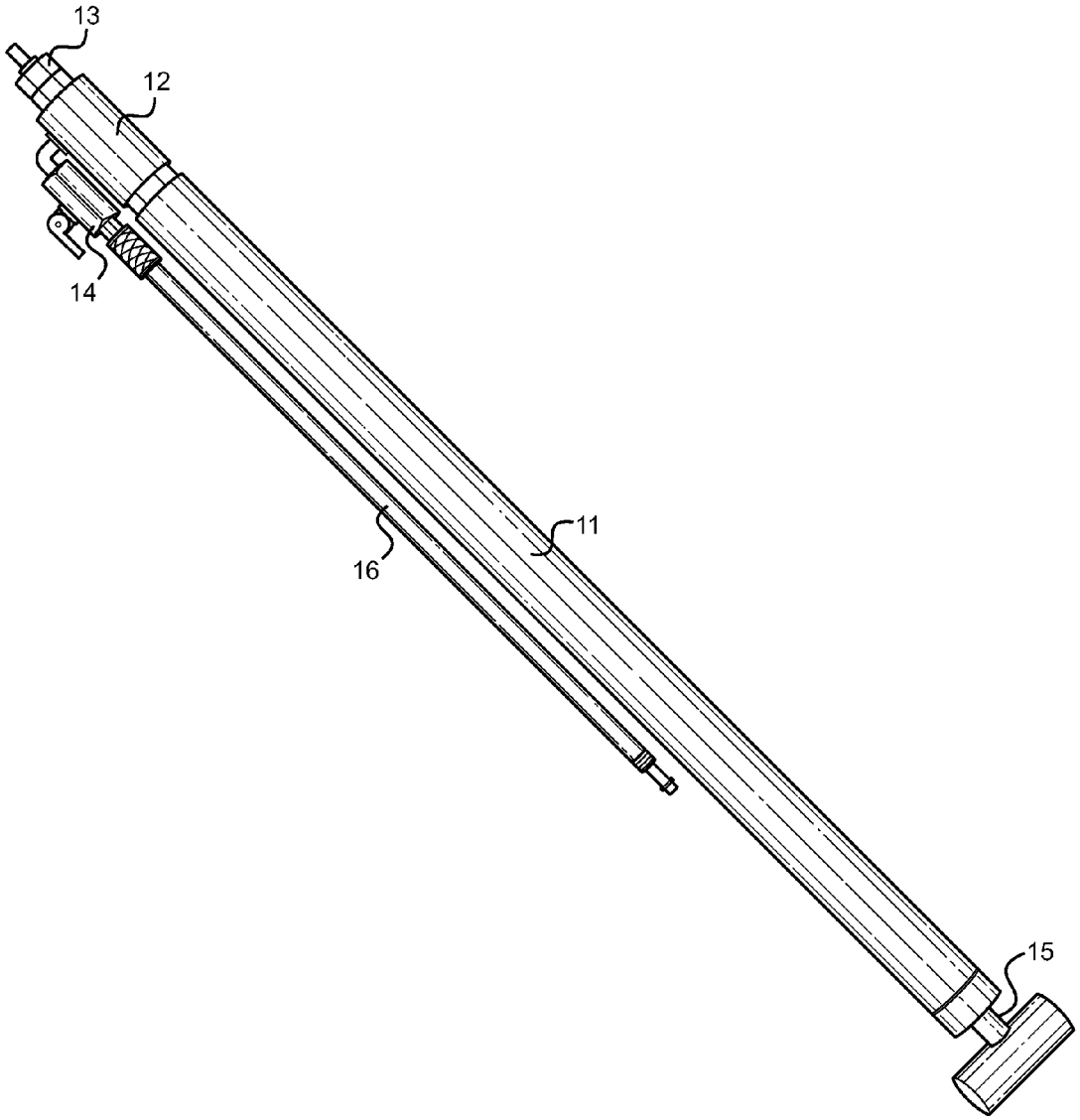
FIG. 1 shows a perspective view of a device according to an embodiment of the present invention.

Reference is made herein to the attached drawings. Like reference numerals are used throughout the drawings to depict like or similar elements of the device. For the purposes of presenting a brief and clear description of the present invention, the preferred embodiment will be discussed as used for applying drywall texture to a surface. The figures are intended for representative purposes only and should not be considered limiting in any respect.

Referring now to FIG. 1, a perspective view of a drywall texture application device according to the present invention is shown. The device generally comprises a hollow tube 11 having a first end and a second end, a spray nozzle 12 having a connector 14, a piston (not visible in this figure), and a ramrod 15. The spray nozzle 12 is removably attached to the hollow tube 11.

In order to operate the device, a user must first fill the hollow tube 11 with drywall mud. First, the user removes the spray nozzle 12 from the hollow tube 11 and moves piston into an actuated position by depressing the ramrod 15. The user then inserts the first end (the open end) of the tube 11 into a container of drywall compound that has previously been hydrated, hereafter referred to as drywall mud, and pulls the ramrod 15 out past the second end of the hollow tube 11, which draws the drywall mud into the tube 11. The user then reattaches the spray nozzle 12 to the first end of the filled hollow tube 11. When the spray nozzle 12 is secured to the first end of the hollow tube 11, any drywall mud within the interior volume of the tube 11 is held therein until emitted by the user.

The device also comprises an air hose 16 which is removably attached to the connector 14. In a preferred embodiment, and as depicted herein, the connector 14 is a ball valve. The ball valve 14 is threadably connected to the spray nozzle 12 at one end and to the air hose 16 at the other end, which is in turn connected to an external compressed air source (not shown). To operate the device, a user moves the ball valve 14 to an open position, allowing air from a compressed air source to enter the spray nozzle 12. The user then depresses the ramrod 15, which forces drywall mud out of the device through the spray nozzle 12.

An air cap 13 having an inner aperture is interchangeably and removably attached to the spray nozzle 12. The air cap 13 may also comprise one or more outer apertures disposed around the inner aperture. When such an air cap 13 is used, the compressed air disperses the drywall mud via the one or more outer apertures of the air cap 13 after the drywall mud has exited the device through the spray nozzle 12.

Figure 2:
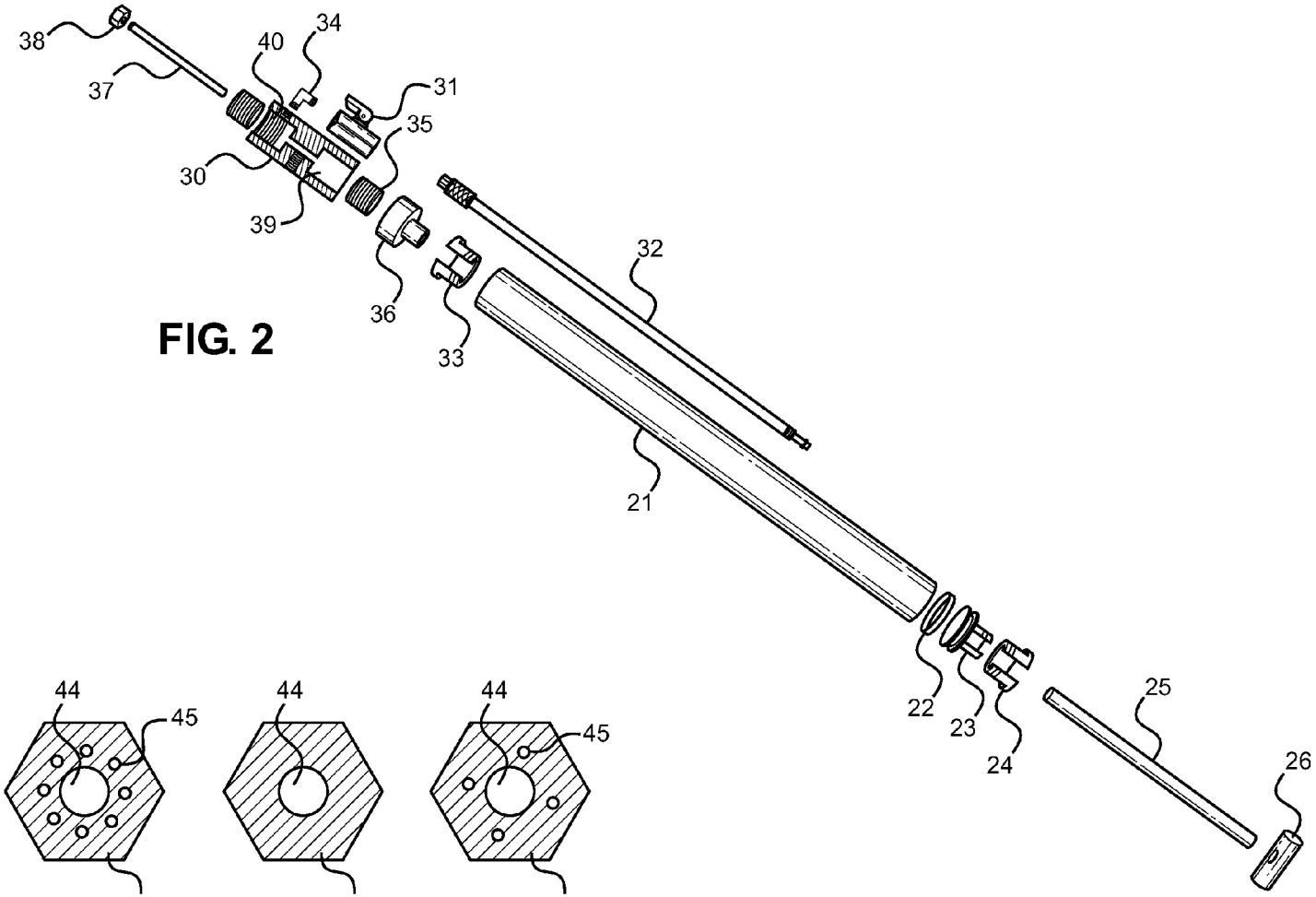
FIG. 2 shows an exploded cross-sectional view of a device according to an embodiment of the present invention.

Referring now to FIG. 2, an exploded view of a device according to one embodiment of the present invention is shown. The device generally comprises a hollow tube 21, a spray nozzle 30, a piston 23, and a ramrod 25. The ramrod 25 preferably has a fixedly attached handle 26. The handle 26 may be attached to the ramrod 25 by a variety of means, including a threaded connection or a set screw. A sealing element 22 is attached to the piston 23 and forms a seal with the interior surface of the tube 21, which in turn prevents drywall mud from exiting through the second end of the tube 21. In one embodiment of the invention, the sealing element 22 comprises a rubber U-cup.

A vent cap 24 is mounted within the tube 21 and prevents the piston 23 from exiting through the second end of the tube 21 when the user pulls back the ramrod 25. The vent cap 24 has an aperture through which the ramrod 25 may freely slide while preventing drywall mud from exiting through the second end of the tube 21. The ramrod 25 is then connected to the distal end of the piston 23 via a set screw, threaded connection, or the like.

The spray nozzle 30 is removably attached to the tube 21 via a threaded connection to the end cap 33, which is fixedly mounted within the first end of the tube 21. As depicted, the spray nozzle 30 is straight, but an angled spray nozzle may also be used. The spray nozzle 30 has apertures at its proximate and distal ends.

In one embodiment of the present invention, and as shown in FIG. 2, the spray nozzle 30 is connected to the end cap 33 via a first threaded adapter 35 and a second threaded adapter 36. The second threaded adapter 36 is fixedly attached to the interior surface of the end cap 33. The threaded adapters 35 and 36 have fluid channels that enable drywall mud to travel from the tube 21 into the spray nozzle 30. A direct threaded connection between the end cap 33 and the spray nozzle 30 may also be utilized.

The spray nozzle 30 comprises an inner channel 41 comprising a first chamber 39 having a first inlet in communication with the interior volume of the tube 21, a second chamber 40 having a second inlet in communication with a connector 31, and an outlet through which the drywall mud is expelled. The drywall mud enters the first chamber 39 via the force from the piston 23 that is applied when a user depresses the ramrod 25. A fluid nozzle 37 that extends past the end of the spray nozzle 30 is disposed within the inner channel 41 and is in fluid communication with the first chamber 39. When a user depresses the ramrod 25, drywall mud from the tube 21 is forced into the first chamber 39 and then exits the device through the fluid nozzle 37.

An external air supply (not shown) connects to the second chamber 40 of the spray nozzle 30 via a removably attached air hose 32. The air hose 32 connects to a connector such as a ball valve 31, which in turn connects to the spray nozzle 30 via an elbow fitting 34. When the ball valve 31 is in a closed position, no compressed air may enter the second chamber 40 of the spray nozzle 30. As a user moves the ball valve 31 towards an open position, compressed air enters the second chamber 40.

An air cap 38 is removably mounted over the fluid nozzle 37 and removably secured to the spray nozzle 30 via a threaded connection. In one embodiment of the present invention, the air cap 38 comprises one or more outer apertures in fluid communication with the second chamber 40. When the ball valve 31 is in an open position, compressed air flows through the second chamber 40 and exits the device through the outer apertures of the air cap 38. In operation, the compressed air discharged through the air cap 38 disperses the drywall mud that is forced out of the device through the fluid nozzle 37 by a depression of the ramrod 25. The number of outer apertures through which the compressed air may flow affects the resulting texture pattern of the drywall mud. Different air caps may be used to create various textures, such as knockdown, stucco, or orange peel. Users may also adjust the ball valve 31 until an air pressure resulting in the desired texture is achieved.

Figures 3A, 3B, 3C:
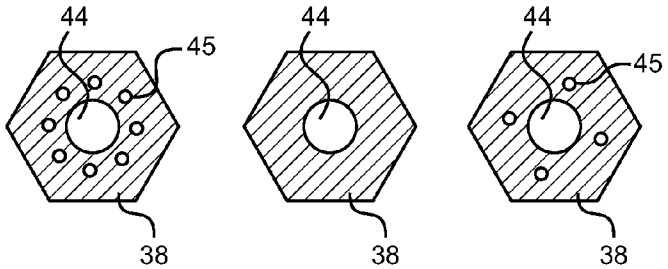
FIG. 3A shows a cross sectional view of an air cap element from an embodiment of the present invention.
FIG. 3B shows a cross sectional view of an air cap element from an embodiment of the present invention.
FIG. 3C shows a cross sectional view of an air cap element from an embodiment of the present invention.

Referring now to FIGS. 3A, 3B, and 3C, cross-sectional depictions of the air caps that may be used with the device are shown. The air caps are removably attachable to the first end of the spray nozzle 30. The air caps comprise at least an inner aperture 44. Alternative embodiments of the air caps comprise one or more outer apertures 45 situated around the inner aperture 44. The air cap is slidably mounted over fluid nozzle 37 and is then removably secured to spray nozzle 30 via a threaded connection. The outer apertures 45 are in fluid communication with the second chamber 40 of the spray nozzle 30 and allow compressed air to be discharged therefrom.

The arrangement of the air cap outer apertures 45 affects the texture pattern of the discharged drywall mud, allowing for different texture patterns to be obtained by changing air caps. In operation, compressed air discharged from the air cap outer apertures 45 disperses the drywall mud discharged from the fluid nozzle 37. The exit pattern and resulting texture of the dispersed drywall mud is determined by the air cap selected by the user.

An air cap without outer apertures, such as the one shown in FIG. 3B, provides the least amount of spread and can be used to apply an orange peel texture or other similar textures. With this air cap, compressed air does not disperse the drywall mud, which is forced through the fluid nozzle 37 by a depression of the ramrod 25. An air cap with outer apertures 45, such as the one shown in FIG. 3C, allows the drywall mud discharged through the fluid nozzle 37 to be dispersed by the compressed air discharged through the air cap outer apertures 45 via the second chamber 40. The air exiting outer apertures 45 further mixes with the drywall mud exiting through inner aperture 44 to create to a wider splatter pattern. Such air caps can be used to obtain a knockdown texture and other texture patterns that require a greater spread of material and greater atomization than orange peel texture. Adding more outer apertures to the air cap increases the spread of the spray pattern. An air cap that has a greater number of outer apertures 45 such as the one shown in FIG. 3A can be used to apply an acoustic or stucco texture pattern, which requires a large spray pattern and a greater distribution of material.

The rate at which the user depresses the ramrod 25 varies the feed rate of drywall mud into the first chamber 39 of the spray nozzle 30, which also affects the resulting texture pattern. Users can depress the ramrod 25 quickly to force more through the fluid nozzle 37 at a faster rate, thereby increasing the amount of material discharged from the device over a period of time. The combination of interchangeable air caps and the user-controlled drywall mud feed rate allows a user to replicate a wide variety of commonly used drywall textures, such as orange peel, stucco, knockdown, and other textures.

Figure 4:
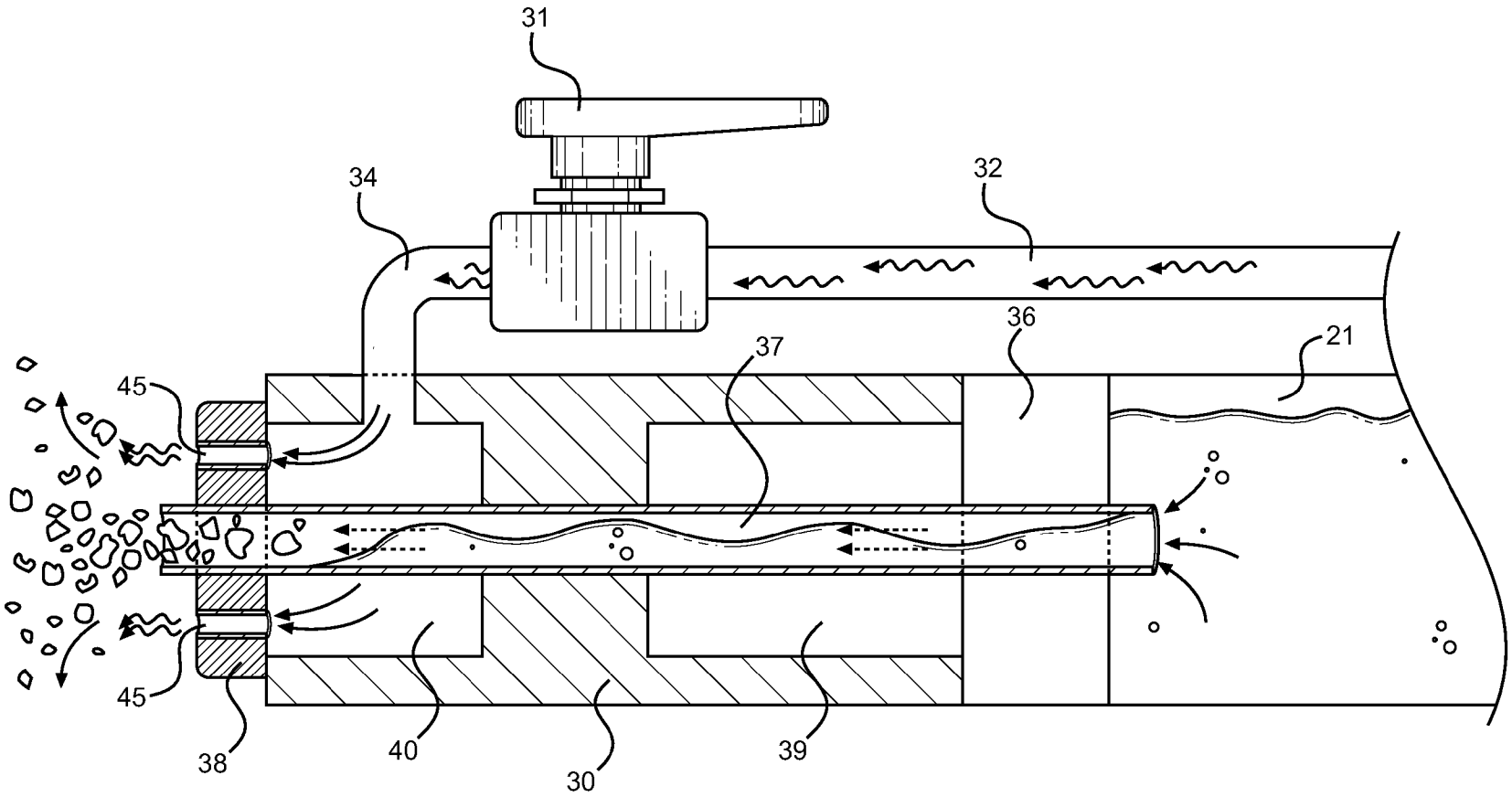
FIG. 4 shows a cross-sectional view of a spray nozzle element from an embodiment of the present invention

Referring now to FIG. 4, a cross-sectional view of the spray nozzle 30 is shown. In the depicted embodiment of the invention, the attached air cap 38 is one having outer apertures 45 similar to those shown in FIG. 3A and FIG. 3C. The outer apertures 45 are in fluid communication with the second chamber 40. When a user depresses the ramrod 25, drywall mud flows from the tube 21 through the first chamber 39 via the fluid nozzle 37 and out of the device. When the ball valve 31 is in an open position, compressed air enters the second chamber 40 and exits the device through the air cap outer apertures 45, causing the drywall mud to be dispersed into a spray pattern. Different arrangements of the outer apertures 45 change the pattern of the dispersed drywall mud. Users may choose an air cap 38 that generates a desired texture of the dispersed drywall mud.

Figure 5:
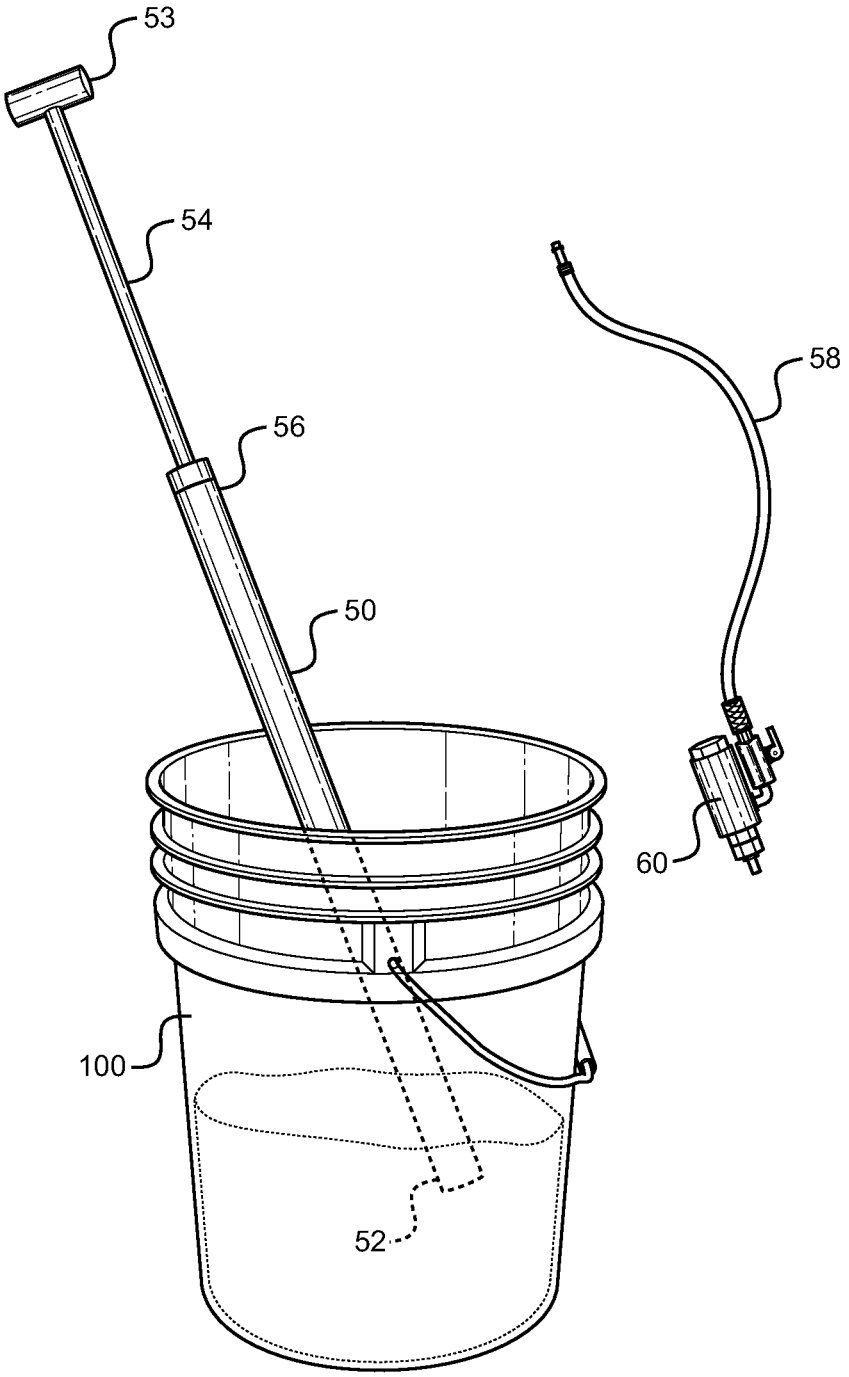
FIG. 5 shows a perspective view of a device according to one embodiment of the present invention in operation.

FIG. 5 depicts a device according to the present invention in a disassembled state, ready to be filled with drywall mud. In order to fill the device with drywall mud, a user removes the spray nozzle 60 from the tube 50. A user then inserts the open end 52 of the tube 50 into a container 100 filled with pre-mixed drywall mud. Next, the user moves the ramrod 54 past the second end 56 of the tube 21 by pulling back on the handle 53, creating a suction which causes the tube 50 to fill with drywall mud. The user then reattaches the spray nozzle 60 to the tube 50 and attaches an air hose 58 to an external compressed air supply. Once it is filled with drywall mud, a user may aim the spray nozzle 60 towards a surface to be coated, turn the ball valve to an open position, and depress the ramrod 54 using the handle 53.

Figure 6:
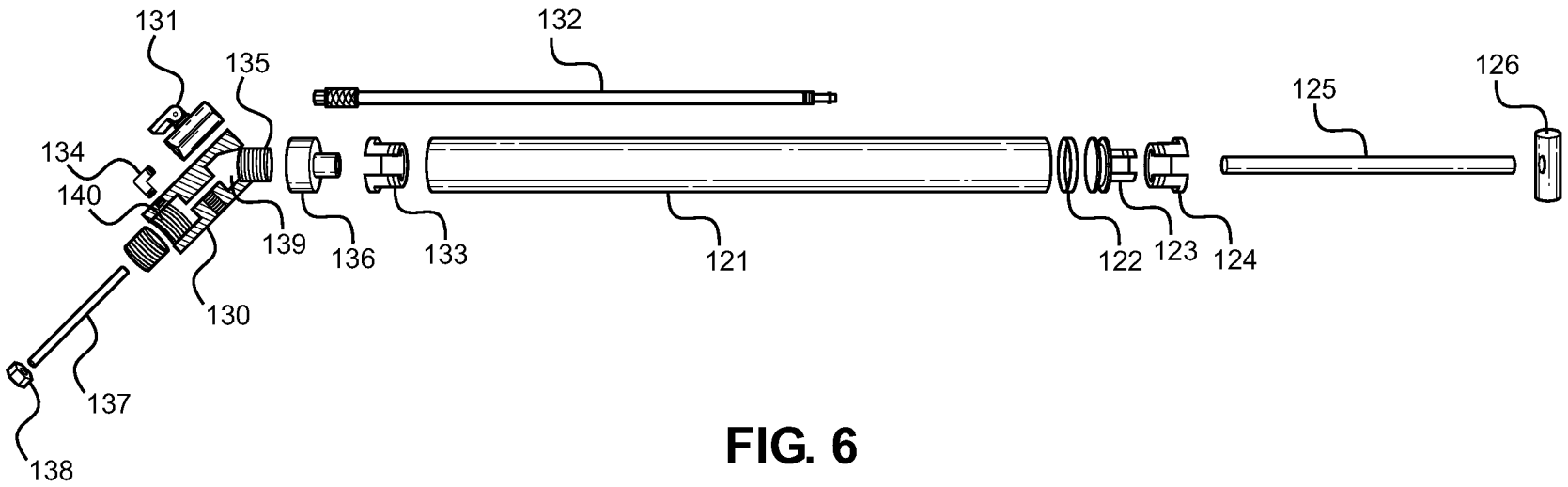
FIG. 6 shows an exploded cross-sectional view of a device according to an alternative embodiment of the present invention.

FIG. 6 depicts an alternative embodiment of the present invention. An angled spray nozzle 130 may be used in place of a straight spray nozzle 30. The components and principles of operation of the device having an angled spray nozzle 130 remain the same as those in a device having a straight spray nozzle 30. The angled spray nozzle 130 facilitates the coating of ceilings or other overhead surfaces without requiring the user to hold the device at a substantially vertical angle. While the angled spray nozzle 130 makes it easier to coat overhead surfaces with drywall mud, both the straight and angled embodiments of the present invention may be used interchangeably to coat overhead surfaces or any other surface.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A drywall texture application device, comprising:

a hollow tube having a first end and a second end;

a piston slidably disposed within the second end of the tube;

a ramrod attached to the piston and extending toward the second end of the hollow tube;

a spray nozzle connected to the first end of the hollow tube;

the spray nozzle comprising an inner channel, a fluid nozzle, an air cap having an inner aperture interchangeably attached thereto, and a connector connectable to an external air source, the fluid nozzle having a proximal end and a distal end, the fluid nozzle having an entire linear length with a common cross-sectional diameter along the entire linear length, the fluid nozzle being imperforate along the entire linear length, the distal end forming a single output orifice forward of the air cap allowing unrestricted linear passage of the drywall mud through the single output orifice; and the inner channel comprising a first chamber and a second chamber, the first chamber having an inlet in communication with the hollow tube and an outlet in communication with the fluid nozzle, the second chamber having an inlet in communication with the connector and an outlet in communication with the air cap;

wherein depressing the piston causes material within the tube to be forced into the first chamber and expelled therefrom the fluid nozzle.

2. The drywall texture application device of claim 1, wherein the air cap is further defined as having at least two apertures forming air exit ports for the discharge of air, the apertures being arranged in a vertical plane, the distal end of the fluid nozzle projecting forwardly of the vertical plane.

3. The drywall texture application device of claim 1, wherein the spray nozzle is removably connected to the first end of the tube.

4. The drywall texture application device of claim 1, wherein the connector comprises a removably attached air hose.

5. The drywall texture application device of claim 4, further comprising a valve disposed between and in fluid communication with the spray nozzle and the removably attached air hose.

6. The drywall texture application device of claim 5, wherein the valve is a ball valve.

7. The drywall texture application device of claim 5, wherein the removably attached air hose is configured to connect to an external compressed air supply.

8. The drywall texture application device of claim 1, wherein the ramrod comprises an attached handle member.

9. The drywall texture application device of claim 1, wherein the air cap fittings are slidably mounted along the fluid nozzle and removably attached to the spray nozzle.

10. The drywall texture application device of claim 9, wherein the air cap fittings are removably attached to the spray nozzle via a threaded connection.

11. The drywall texture application device of claim 2, wherein the air cap fittings further comprise at least one outer aperture disposed around the inner aperture, the at least one outer aperture being in fluid communication with the connector.

12. The drywall texture application device of claim 1, wherein air from the external air source exits through the at least one outer aperture and disperses the material expelled from the fluid nozzle.

13. The drywall texture application device of claim 2 wherein the fluid nozzle is further defined as having an exit point adjustable along a horizontal plane, the fluid nozzle being slidably adjustable to increase and decrease the distance between the distal end of the fluid nozzle and the vertical plane of the air exit ports allowing for different spray patterns.

14. The drywall texture application device of claim 13 further comprising a screw hole and a set screw centrally located in the housing, the set screw configured to radially engage the fluid nozzle preventing axial movement of the fluid nozzle when engaged.

15. The drywall texture application device of claim 1 wherein the spray nozzle is angled.

16. A drywall texture application device, comprising: a hollow tube having a first end and a second end; a piston slidably disposed within the second end of the tube; a ramrod attached to the piston and extending toward the second end of the hollow tube; a spray nozzle connected to the first end of the hollow tube; the spray nozzle having an inner channel, a fluid nozzle, and an air cap, the fluid nozzle having a proximal end and a distal end, the fluid nozzle having an entire linear length with a common cross-sectional diameter along the entire linear length, the fluid nozzle being imperforate along the entire linear length, the distal end forming a single output orifice allowing unrestricted linear passage of the drywall mud through the single output orifice, the air cap having at least two apertures for the discharge of air, the apertures being arranged in a vertical plane, the distal end of the fluid nozzle projecting forwardly of the vertical plane; the inner channel comprising a first chamber and a second chamber, the first chamber having an inlet in communication with the hollow tube and an outlet in communication with the fluid nozzle, the second chamber having an inlet in communication with the connector and an outlet in communication with the air cap; the fluid nozzle having an exit point adjustable along a horizontal plane, the fluid nozzle being slidably adjustable to increase or decrease the distance between the distal end of the fluid nozzle and the vertical plane of the air exit ports allowing for different spray patterns; wherein depressing the piston causes material within the tube to be forced into the first chamber and expelled therefrom the fluid nozzle; and wherein air from the external air source exits through the at least one outer aperture and disperses the material expelled from the fluid nozzle.

* * * * *